United States Patent [19]

Leonardi

[11] Patent Number: 4,601,117

[45] Date of Patent: Jul. 22, 1986

[54] RAKE ADJUSTING DEVICE, PARTICULARLY FOR REAR ENTRANCE SKI BOOTS

[75] Inventor: Alfio Leonardi, Rome, Italy

[73] Assignee: Nordica S.p.A., Montebelluna, Italy

[21] Appl. No.: 631,369

[22] Filed: Jul. 16, 1984

[30] Foreign Application Priority Data

Jul. 26, 1983 [IT] Italy ..... 22485/83[U]

[51] Int. Cl.[4] ..... A43B 5/04

[52] U.S. Cl. ..... 36/120; 36/54

[58] Field of Search ..... 36/117–121, 36/105, 54

[56] References Cited

U.S. PATENT DOCUMENTS

| | | | |
|---|---|---|---|
| 4,095,356 | 6/1978 | Robran et al. | 36/121 |
| 4,449,274 | 5/1984 | Balbinot | 36/117 X |
| 4,461,103 | 7/1984 | Annovi | 36/121 |

FOREIGN PATENT DOCUMENTS

| | | | |
|---|---|---|---|
| 1810291 | 6/1970 | Fed. Rep. of Germany | 36/54 |
| 1817978 | 4/1976 | Fed. Rep. of Germany | 36/120 |
| 3336063 | 4/1984 | Fed. Rep. of Germany | 36/117 |

*Primary Examiner*—James Kee Chi

*Attorney, Agent, or Firm*—Guido Modiano; Albert Josif

[57] ABSTRACT

A device for adjusting the rake particularly in ski boots of the rear entrance type comprises, located on the boot shell, a plurality of spaced seats. Releasably engageable in one of the seats is a dog, provided on one lever journalled on the boot front quarter to set the front quarter rake relatively to the boot shell.

11 Claims, 5 Drawing Figures

RAKE ADJUSTING DEVICE, PARTICULARLY FOR REAR ENTRANCE SKI BOOTS

BACKGROUND OF THE INVENTION

This invention relates to a rake adjusting device, particularly for rear entrance ski boots.

As is known, increased acceptance is being gained of rear entrance ski boots, namely, ski boots having front and rear quarters connected to a boot shell.

Presently, a greatly felt problem, is that of positioning the front quarter relatively to the boot, that is, the problem of the forward rake assumed by the front quarter with respect to the boot shell.

In order to preset said rake angle according to the user's contengent requirements, it is current practice to use means which, however, are quite complex and not always fully adequate for the purpose.

SUMMARY OF THE INVENTION

It is a primary object of the invention to obviate such prior deficiencies by providing a device for adjusting the quarter rake relatively to the shell in rear entrance ski boots, which can be very quickly and easily operated.

A further object of the invention is to provide a device as indicated, which enables the user to preset the quarter rake relatively to the shell, by selection of the rake angle from a range of rake angles which may be assumed without altering the boot construction.

It is another object of this invention to provide a rake adjusting device which practically produces an adjustment of the forward rake of the front quarter of the shell, whilst allowing, if required, the front quarter to freely swing rearwards within a certain distance from the shell.

A not unimportant object of the invention is to provide a device as indicated, which is quick and simple to assemble, and may be assembled from a limited number of component parts.

These and other objects, such as will be apparent hereinafter, are achieved by a rake adjusting device, particularly for rear entrance ski boots, according to the invention, characterized in that it comprises, located on the boot shell, a plurality of spaced seats, one seat in said plurality being releasably engaged by a dog provided on a lever associated with the boot front quarter to set the rake angle of said front quarter of said boot shell.

BRIEF DESCRIPTION OF THE DRAWINGS

Further features and advantages will be more readily understood from the following detailed description of a rake adjusting device, particularly for rear entrance ski boots, as illustrated by way of example and not of limitation in the accompanying drawings, where.

DESCRIPTION OF THE PREFERRED EMBODIMENTS

Figure 1:
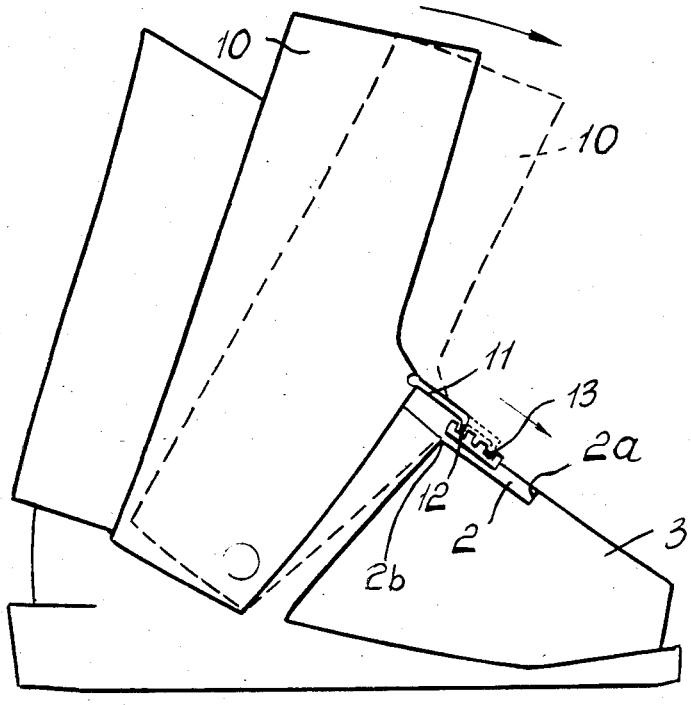
FIG. 1 shows schematically a ski boot incorporating the rake adjusting device of this invention.
Figure 2:
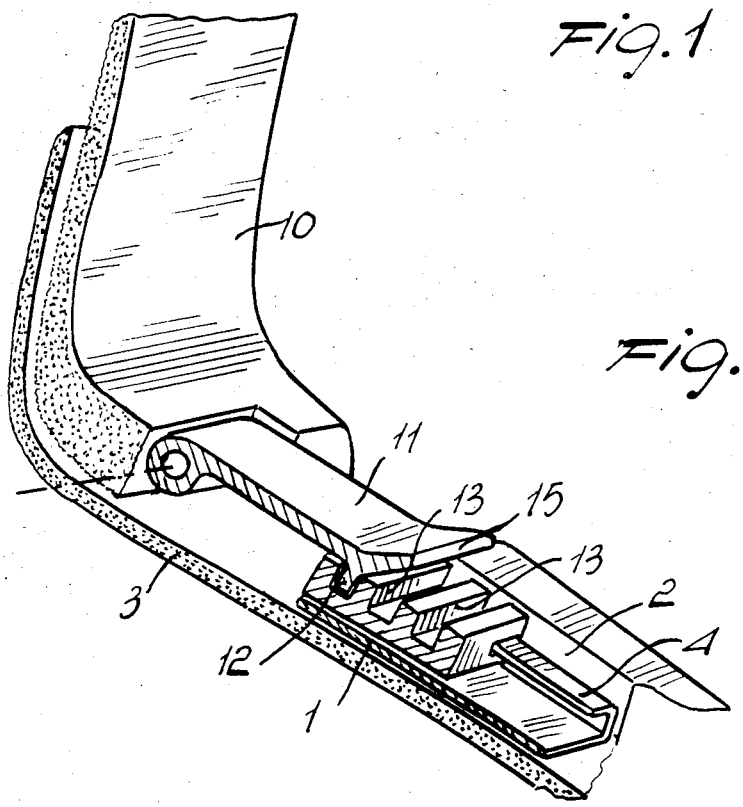
FIG. 2 shows a partly cut-away perspective view of the device of FIG. 1.

With reference to the drawing views, a rake adjusting device particularly for rear entrance ski boots, according to the invention, comprises a block 1 which is accommodated in a groove 2 formed in the front upper portion of the shell 3 of a ski boot.

The block 1 is guided for sliding movement along said groove in a substantially longitudinal direction by a guide element 4 provided in the groove itself.

The block 1 engages by contact with the front or longitudinal end, indicated at *2a*, of the groove 2 to practically form a limit stop for the forward swing of the front quarter 10 relatively to the shell. The groove 2 has an end *2b* facing the front quarter 10.

Hinged to the front quarter 10, and specifically at the forward region thereof, is the end of a lever 11 which is provided, on its front face, with a dog 12 adapted to be releasably received in one of the seats 13 defined on the top face of the block 1.

Advantageously, there are provided a plurality of seats 13 spaced apart from one another at increased distances from the limit stop *2a* to determine, depending on which seat has been selected to be engaged by the dog 12, the maximal rake angle of the front quarter 10 relatively to the shell 3.

The cited lever 11 is provided at the front with a gripping lug 15 to facilitate lever handling.

Figure 3:
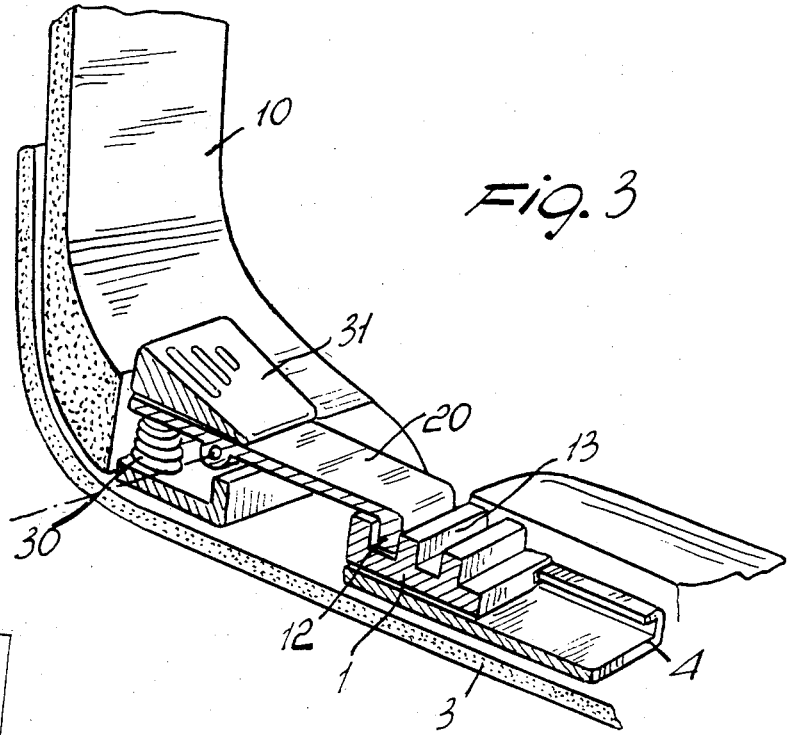
FIG. 3 is a schematic perspective view of this rake adjusting device with a pushbutton operated lever.
Figure 4:
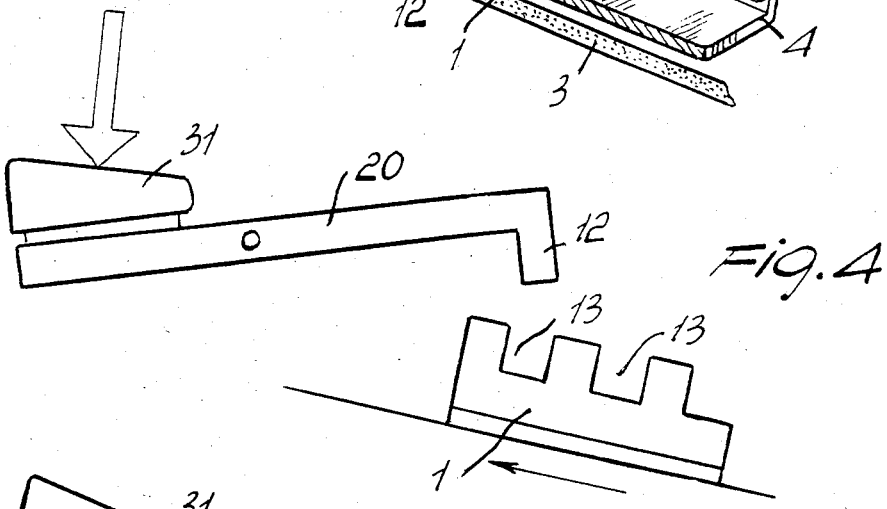
FIGS. 4 and 5 schematically show a side view of the device of FIG. 3, respectively in the released and engaged conditions thereof.
Figure 5:
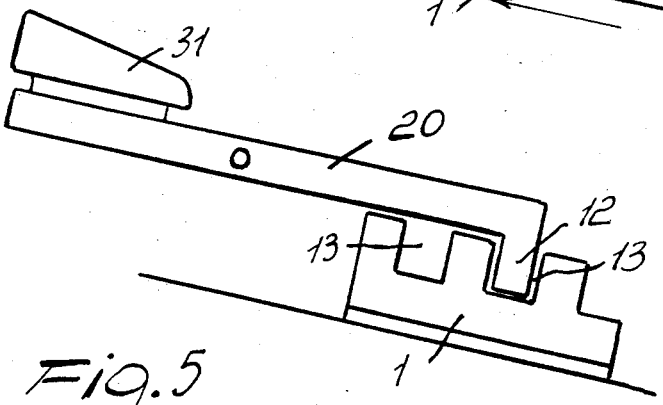

With reference now to FIGS. 3 to 5, the device has an engagement lever, indicated at 20, which is hinged to the quarter 10 at a central portion thereof and has its front end provided with the dog 12 for engagement within the seats 13, as previously cited.

At the rear end of the lever, there acts an elastic means comprising a spring 30 which acts against the bottom face of the lever to generate an elastic bias effective to hold the dog 12 firmly in engagement with the seats 13.

At the rear end, on its uppermost face, the lever 20 has an actuating pushbutton 31 which, by compressing the spring 30, effects, in a similar manner to that described previously, disengagement of the dog 12 from a seat 13, thus affording the user with the faculty to position the dog 12 at any selected seat 13.

With this embodiment, the engagement between the dog 12 and seat 13 is afforded with increased stability because the dog, owing to the coupling of the lever to a pivot within its central portion, is urged elastically into a seat 13.

It may be appreciated from the foregoing that the invention achieves its objects, and in particular, it should be noted that adjustment of the forward rake, that is of the maximum forward oscillation of the quarter relatively to the shell, is simply effected by releasing the dog 12 from the seat 13 of the block 1 wherein it is accommodated and by flexing the quarter 10 forward or rearward so as to bring the dog 12 into an alternative seat thus affording a greater or lesser rake angle.

Of considerable importance is also the fact that the adjusting feature is extremely simple and can be readily operated by the user at the time of using the ski boot, thereby affording adjustment of the boot fit as convenient.

In practicing the invention, the materials employed, providing they are compatible with the intended specific use, as well as the dimensions and contingent shapes, may be any suitable ones to meet individual applicational requirements.

I claim:

1. A rake adjusting device particularly for rear entrance ski boots having a shell, and at least one quarter hinged thereto, said rake adjusting device comprising a plurality of engageable elements, engagement means and stop means, said plurality of engageable elements being associated with said shell and adapted for longitudinal displacement movement in a direction extending along a portion thereof, said engagement means being associated with said at least one quarter and selectively releasably engageable with at least one of said plurality of engageable elements, said stop means being adapted for delimiting said longitudinal displacement movement of said plurality of engageable elements.

2. A rake adjusting device particularly for rear entrance ski boots according to claim 1, wherein said plurality of engageable elements comprises a plurality of spaced seats, said plurality of spaced seats being provided in a block, said block being adapted for guided sliding displacement movement in a groove, said groove being provided on said portion of said shell, said stop means, comprising at least one end of said groove, said block being further adapted for abutment engagement with said at least one end of said groove.

3. A rake adjusting device particularly for rear entrance ski boots according to claim 1, wherein said engagment means comprises a lever having a front end and a rear end, said lever including a dog, said rear end of said lever being hingedly connected to said at least one quarter, said dog being provided at said front end of said lever.

4. A rake adjusting device particularly for rear entrance ski boots according to claim 1, wherein said engagement means comprises a lever having a front end, a rear end, a substantially central portion and a dog adapted for engaging at least one of said plurality of engageable elements, said lever being hingedly connected to said at least one quarter at said substantially central portion, said dog being provided at said front end of said lever.

5. A rake adjusting device according to claim 4 further comprising elastic biasing means, said elastic biasing means being adapted to act on said rear end of said lever to bias said dog towards engagement with one of said plurality of engageable elements.

6. A rake adjusting device particularly for rear entrance ski boots according to claim 5 further comprising a pushbutton element, said pushbutton element being provided on the uppermost face of said lever, at said rear end thereof and adapted to be actuated against said elastic biasing means for causing disengagement of said dog from one of said plurality of spaced seats.

7. In a ski boot including a shell and a front quarter hinged thereto for swinging movement in a longitudinal direction of the ski boot, a maximal forward rake angle adjusting device comprising means defining a groove in said shell, said groove extending in the longitudinal direction of the ski boot and having one longitudinal end thereof facing said front quarter and an opposite longitudinal end thereof at a distance from said one end and defining a limit stop formation, a block member with a longitudinal extension and arranged within said groove and slidable therein in the longitudinal direction thereof from a rear position near said one end to a forward position at said limit stop formation, said block member having a series of successive engagement seats distributed over the longitudinal extension of said block member at increasing distances from said limit stop formation, a lever hinged on said quarter about an axis perpendicular to said longitudinal direction at a distance from said one longitudinal end of said groove, said lever having a dog formation at a distance from said axis and in the reach of said series of successive engagement seats to selectivelly engage one of said successive engagement seat at a selected distance from said limit stop formation to thereby adjust the maximal forward rake angle.

8. A device according to claim 7, further comprising guide means for said block member within said groove.

9. A device according to claim 7, wherein said lever comprises hinge means at an end thereof remote from said block member to provide hinge connection between said lever and said front quarter.

10. A device according to claim 7, wherein said lever comprises hinge means in an intermediate position thereof to provide hinge connection between said lever and said front quarter.

11. A device according to claim 7, further comprising spring means for urging said dog into engagement position with one of said engagement seats and actuation formations for hand actuating said lever.

* * * * *